US005747756A

United States Patent [19]

Boedecker

[11] Patent Number: 5,747,756

[45] Date of Patent: May 5, 1998

[54] ELECTROLUMINESCENT BACKLIT KEYPAD

[75] Inventor: Todd Jay Boedecker, Auburn, Wash.

[73] Assignee: GM Nameplate, Inc., Seattle, Wash.

[21] Appl. No.: 711,275

[22] Filed: Sep. 10, 1996

[51] Int. Cl.[6] ..... H01H 9/20

[52] U.S. Cl. ..... 200/5 A; 200/310; 200/314

[58] Field of Search ..... 200/5 R, 5 A, 200/512–517, 308, 310–317; 340/815.4, 815.42, 815.45, 815.47, 815.48, 815.49, 815.5, 815.53, 815.55, 815.73; 362/24.95, 295; 379/364, 365, 368–370, 422, 433

[56] References Cited

U.S. PATENT DOCUMENTS

| | | | |
|---|---|---|---|
| 4,056,701 | 11/1977 | Weber | 200/314 |
| 4,060,703 | 11/1977 | Everett, Jr. | 200/5 A |
| 4,288,672 | 9/1981 | Puccini | 200/314 |
| 4,320,268 | 3/1982 | Brown | 200/5 A |
| 4,343,975 | 8/1982 | Sado | 200/314 |
| 4,449,024 | 5/1984 | Stracener | 200/317 |
| 4,477,430 | 10/1984 | LaRose | 362/84 |
| 4,532,395 | 7/1985 | Zukowski | 200/314 |
| 4,551,598 | 11/1985 | Hamilton et al. | 200/314 |
| 4,609,791 | 9/1986 | Abbat | 200/5 A |
| 4,636,593 | 1/1987 | Novak et al. | 200/5 A |
| 4,683,360 | 7/1987 | Maser | 200/314 |
| 4,710,597 | 12/1987 | Loheac | 200/5 A |
| 5,138,119 | 8/1992 | Demeo | 200/5 A |
| 5,149,923 | 9/1992 | Demeo | 200/5 A |
| 5,225,818 | 7/1993 | Lee et al. | 340/711 |
| 5,304,764 | 4/1994 | Kobayashi | 200/314 |
| 5,401,927 | 3/1995 | Lundell et al. | 200/314 |
| 5,471,023 | 11/1995 | Kaizu et al. | 200/310 |
| 5,491,313 | 2/1996 | Bartley et al. | 200/310 |
| 5,568,367 | 10/1996 | Park | 362/109 |

OTHER PUBLICATIONS

GM Nameplate, INTAQ Brochure, "Elastomer Key Panels", Rev. Feb. 1995.

San Teh Technical Information, 1988.

*Primary Examiner*—Michael L. Gellner

*Assistant Examiner*—Michael A. Friedhofer

*Attorney, Agent, or Firm*—Christensen, O'Connor, Johnson & Kindness PLLC

[57] ABSTRACT

A flexible-touch keypad (100) is backlit by an electroluminescent layer (118) that overlies an actuator layer (108) and a circuitry layer (102). The actuator layer (108) includes posts (112A) protruding through apertures (120) in the electroluminescent layer (118) and extending upward toward a translucent flexible surface layer (124). The flexible surface layer (124) is coated with an opaque layer (206), which is etched to form indicia (130). The protruding post (112A) is translucent and functions as a light pipe, directing light upward from the electroluminescent layer (118) and through the translucent surface layer (124) with a substantially uniform light intensity, the light being visible through the etched indicia (130). When a key (128A) on the surface layer (124) is depressed, a corresponding post (112A) is urged downward toward the circuitry layer (102). A conductive pill (116A) attached to the post (112A) contacts a switch area (104) on the circuitry layer (102), thereby completing a circuit. The actuator layer (108) provides tactile feedback when a key (128A) is depressed.

30 Claims, 2 Drawing Sheets

ELECTROLUMINESCENT BACKLIT KEYPAD

FIELD OF THE INVENTION

The present invention relates to illuminated flexible-touch keypads, and more particularly to flexible touch keypads having electroluminescent backlighting of the keypad or markings thereon.

BACKGROUND OF THE INVENTION

Illuminated graphic keypads and buttons for applications such as automobile radios and portable cellular telephones often have backlit keys with indicia that identify the particular function of each button. Such backlit components generally have a light source positioned behind the indicia in order to illuminate the indicia or surrounding key. A common feature of such a keypad is a switch that provides tactile feedback to indicate that the particular key has been actuated.

Paint and laser technology provide a process for manufacturing the surface layers of such buttons. This process may involve the use of a transparent or translucent substrate painted white to form a white translucent layer over the substrate and then painted black to form an opaque covering over the substrate and the white translucent layer. The black covering is then laser etched to form indicia. The transparency of the substrate allows the transmission of light through the surface component for nighttime viewing. The white translucent layer contributes graphic whiteness, allowing the indicia to be more readily visible under natural lighting conditions during daylight hours.

The light source for a backlit key may be an incandescent bulb or light-emitting diode (LED). One problem with such single-point light sources is the uneven distribution of light, resulting in uneven illumination of the keys. Another problem is the increased depth of the keypad necessary to accommodate an incandescent bulb or LED. A third disadvantage is the expense of manufacturing, particularly when one LED or bulb is used for each key. Some backlit keypads use an electroluminescent panel underlying the surface layer to provide the needed illumination. U.S. Pat. No. 4,532,395, issued to Zukowski, discloses a flexible-touch switch panel using an electroluminescent panel as backlighting, with a membrane-type switch underlying the electroluminescent panel. The electroluminescent panel is flexible, so that pressure on an overlying key is transmitted to the underlying membrane switch.

Tactile feedback is a desirable feature on a keypad, the feedback serving as an indication that the key has been actuated. A tactile switch is defined by an American Society for Testing and Materials subcommittee (ASTM F 1570-94) as a switch that has a tactile ratio greater than zero. U.S. Pat. No. 5,149,923, issued to Demeo, discloses a tactile key using a flexible dome that inverts when pressure is applied, the inversion functioning to provide tactile feedback as well as the closing of a switch. Demeo uses an LED underlying each illuminated key.

It is desirable to provide an illuminated flexible-touch keypad that provides the advantages of an electroluminescent lighting source, a tactile feedback switch, and a flexible touch surface, while providing uniform lighting over the entire keypad. It is also desirable to provide such a keypad in which a minimum of layers and separate elements are used, in order to simplify and economize on its manufacturing.

SUMMARY OF THE INVENTION

The present invention provides an illuminated flexible-touch keypad using an electroluminescent panel to backlight the keypad and a translucent light pipe to transmit light to the surface layer, thereby resulting in uniform lighting of keys or indicia thereon. The keypad also provides tactile feedback in order to indicate the actuation of an individual key. The present invention combines a tactile feedback switch with an electroluminescent light source in a manner that preserves the tactile response while providing a substantially uniform light intensity. The invention further provides a flexible surface layer that can be raised and molded into a number of different shapes, thereby allowing a variety of configurations to be presented.

The illuminated flexible touch keypad is made up of multiple layers sandwiched together. The bottom layer is a circuitry layer, having conductive areas spaced from each other in such a manner that closing a connection between corresponding conductive areas completes a circuit. Above the circuitry layer is a flexible surface layer, which is subdivided into one or more key areas. Between the circuitry layer and the flexible surface layer lies an actuator layer, which serves as a switch to close a circuit on the circuitry layer. Also, between the circuitry layer and flexible surface layer lies an electroluminescent panel that illuminates the surface layer. A translucent element spans the space between the electroluminescent panel and the surface layer. The translucent element serves as a light pipe, carrying light from the electroluminescent panel to the surface layer.

In the preferred embodiment, the electroluminescent panel lies above the actuator layer, and the translucent light pipe element extends from a point below the electroluminescent layer up to the surface layer. The translucent light pipe may be attached to the actuator layer and preferably is unitary with the actuator layer. In the preferred configuration, the electroluminescent panel contains spaced apertures, and each translucent light pipe protrudes from the underlying actuator layer through a corresponding aperture in the electroluminescent panel up to the surface layer.

The actuator layer is preferably a translucent, nonconductive, elastomeric material that is formed to provide upwardly extending light pipes. Such an actuator layer has a conductive element, or pill, attached to it in a position that is aligned with corresponding conductors on the circuitry layer. The conductive element is attached to the translucent light pipe, and is movable with it. The conductive pill functions as a switch to close a circuit on the circuitry layer when the corresponding key is depressed, and opens the circuit when the key is released.

Preferably, the flexible surface layer is continuous and translucent, with a white or colored translucent coating overlying the top surface and an opaque coating overlying the translucent coating. One or more etched markings, or indicia, are made through the opaque layer, thereby allowing light to be transmitted through the markings. The translucent coating aids in visibility during daylight hours, but is not necessary for the illuminated keypad to function. Alternatively, the indicia may be opaque markings on a translucent surface layer, so that the opaque markings can be seen on an illuminated background.

The actuator layer may be formed as a translucent, nonconductive, elastomeric base web with one or more translucent posts protruding up, a post serving as both a light pipe and a switch actuator. The posts protrude through apertures in the overlying electroluminescent panel and extend upward to an area defining a key in the flexible surface layer. The post can be formed in a generally cylindrical shape, with the end closest to the surface layer being tapered into a conical form. The post is aligned with a corresponding conductor on the underlying circuitry layer, and also with a corresponding key area on the overlying flexible surface layer.

Preferably, the actuator layer provides tactile feedback to an operator when a key is depressed. One method of providing tactile feedback is by the use of an elastomeric cone connecting the post to the base web of the actuator layer. When a key and the corresponding post are depressed, the cone coupled with the post collapses asymmetrically, thereby providing the desired tactile feedback.

The flexible surface layer may be shaped in a number of different configurations. It may be raised in different areas, each area defining one key. A bezel may overlie the flexible surface layer so that each raised key of the flexible surface layer protrudes through an opening in the bezel. Alternatively, the flexible surface layer may contain contoured ridges, where the ridges define individual keys.

The use of an electroluminescent panel in combination with a translucent actuator that functions as a light pipe provides uniform illumination through the indicia on the keypad. The manufacture of such a combination, particularly where the actuator layer consists of a single elastomeric element, is simple and economical. A continuous top cosmetic surface alleviates the need to have light dams to block light from escaping around individually bezeled keys. In addition, the invention, by having a translucent surface layer with an opaque coating, allows light to travel through the entire surface, minimizing the need for light pipes. This provides flexibility in the placement of graphics, which can be located on parts of the surface layer other than the raised key tops. When combined with a tactile feedback switching mechanism, the present invention provides an aesthetically pleasing, functional, and economic keypad.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
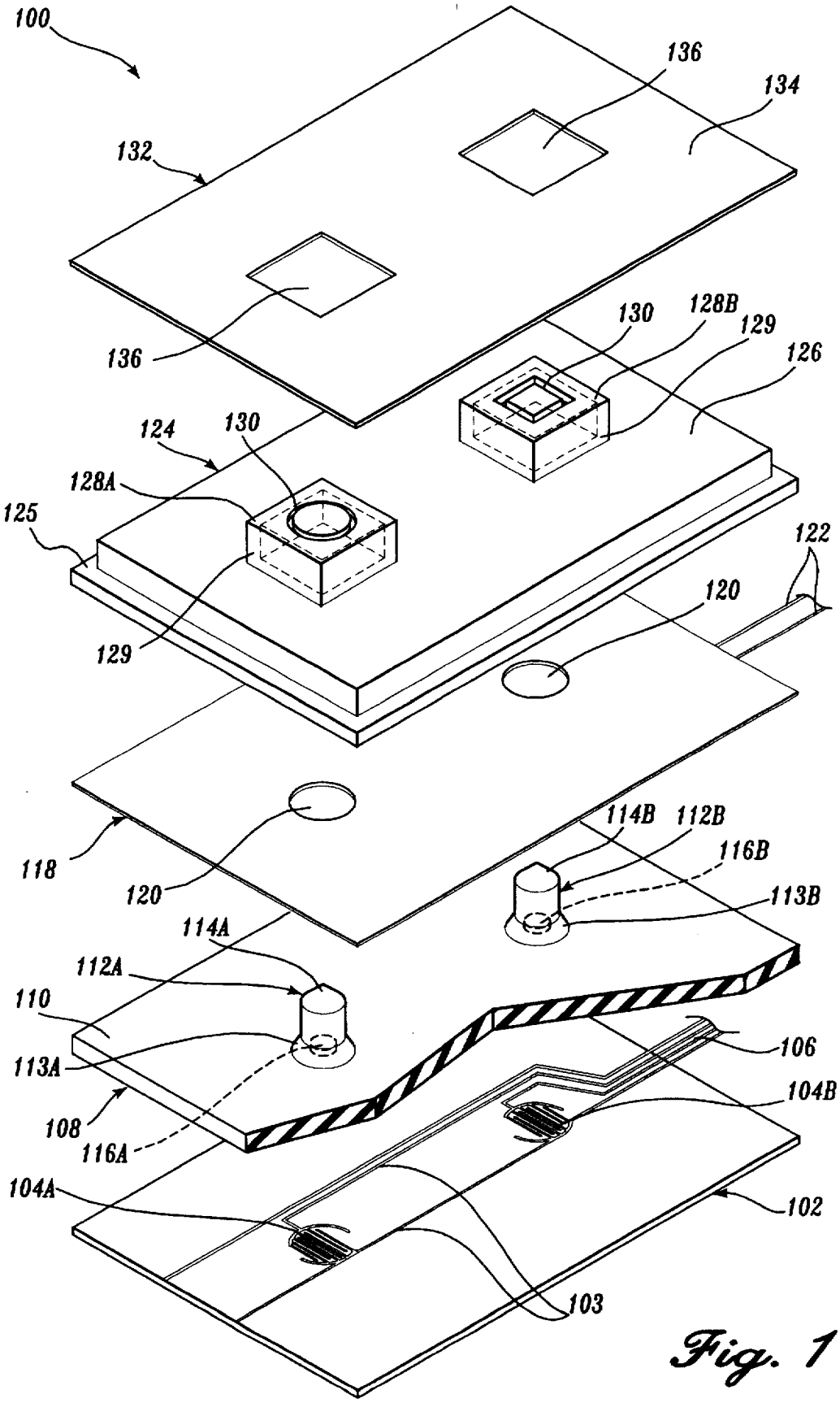
FIG. 1 is an exploded perspective view of an electroluminescent backlit keypad.
Figure 2:
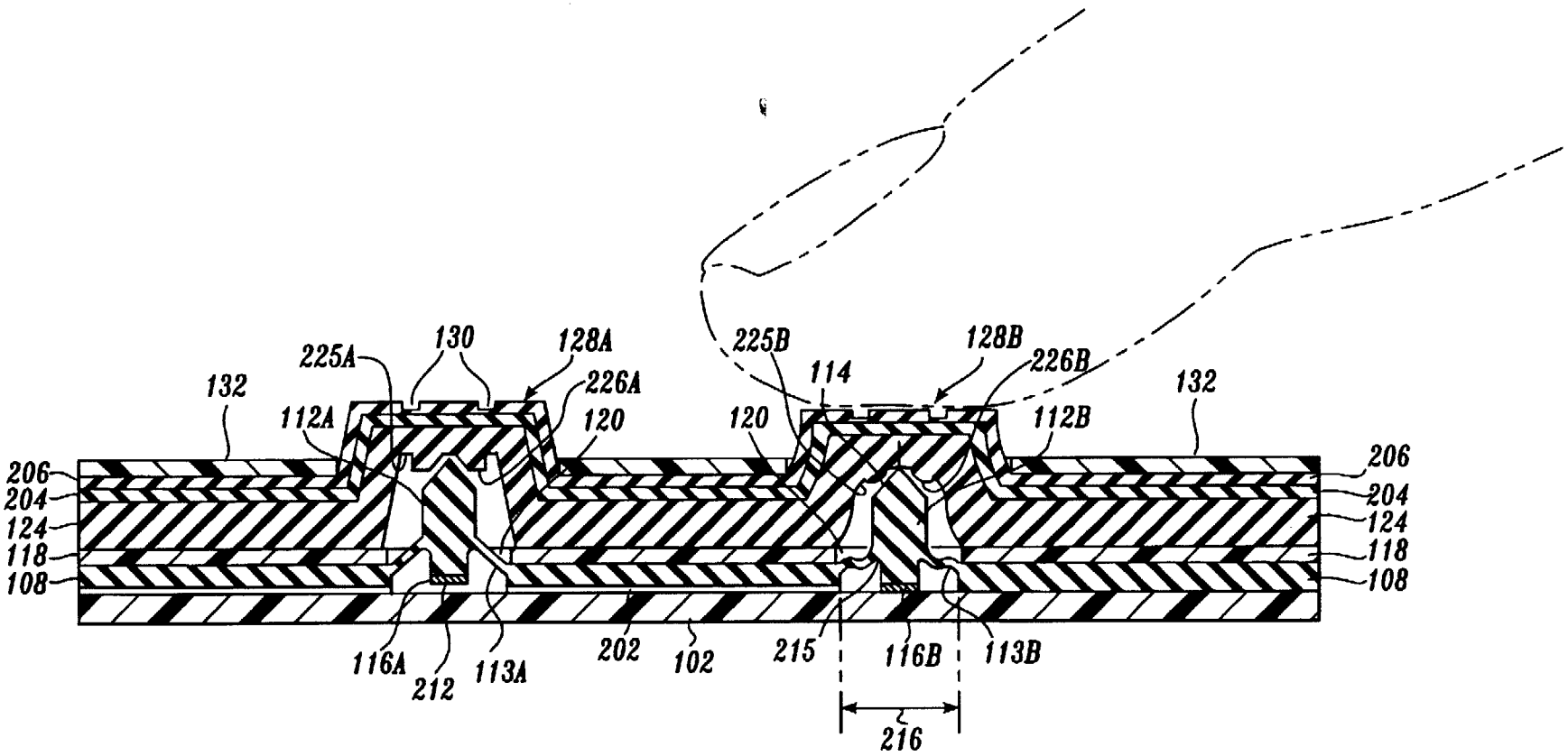
FIG. 2 is a cross section of an electroluminescent backlit keypad according to the present invention.

The preferred embodiment of an electroluminescent backlit keypad 100 according to the present invention is shown in FIG. 1, in an exploded view. FIG. 2, in a cross-sectional view, further illustrates the multiple layers of the electroluminescent backlit keypad 100 according to the present invention. With reference to FIGS. 1 and 2, the present invention comprises a circuitry layer 102 that contains a plurality of conductors 103 thereon. The conductors are formed into one or more switch areas 104A, where two conductors are spaced apart so that a connection between them closes a circuit. The circuitry layer can be rigid PCBs, flex circuits, such as Kapton circuits, printed conductive membrane circuits, or combinations of the above technologies, all of which are well known in the art.

The illuminated keypad of the present invention further comprises an actuator layer 108, which serves as the switching mechanism of the keypad. The preferred configuration, as shown in FIG. 1, includes a translucent, elastomeric base web 110, and at least one element or post 112A composed of the base web 110 material and rising upwardly from the base web. The post 112A has a sloped cone 113A connecting it with the base web 110. When the post 1 12A is depressed, the cone 113A tends to collapse asymmetrically, the uneven collapsing providing tactile feedback to an operator. A shallow, narrow air vent 202 (FIG. 2) etched onto the bottom side of the base web 110 allows air to escape from inside the cone 113A when the post 112A is depressed. Typically a depth of about 0.12 inch is sufficient for an air vent. An air vent 202 typically extends from a cone 113A to an adjacent cone 113B, in order to increase the area of air movement and thereby decrease resistance to depression of the post 112A.

As illustrated in FIG. 2, a conductive element 116A is attached to the bottom end of the post 112A. Post 112A is shown in a normal state, in which the post 112A is in an upper position, and the attached conductive element 116A is spaced above the circuitry layer 102. A second post 112B and conductive element 116B are shown in a depressed position, in which the conductive element 116B contacts the circuitry layer 102 at a corresponding switch area 104B (FIG. 1). The conductive element 116B thereby functions as a switch to complete a circuit between the spaced conductors in switch area 104B. The conductive element 116A can be made from any conventional conductor. A carbon pill, made of carbon-impregnated silicon, is one such conductive element. The conductive element may also be a conductive plate over a rubberized material or conductive ink silk-screened onto a nonconductive material. The bottom surface 212 of a conductive element 116A is typically circular in shape, though other shapes are also possible. Preferably, the diameter of the conductive element 116A is about ½ the diameter 216 of the base 215 of the cone I 13A. For example, a conductive element 116A with a diameter of 2 mm coupled with a cone 113A having a base 215 with a diameter 216 of 4 mm is a typical combination.

The longitudinal axis of a post 112A is generally orthogonal to the plane of the actuator layer 108. The preferable shape for a post 112A is cylindrical, with a conically shaped top 114A. Alternatively, the top of the post 112A may be a full-radius convex sphere. The conical shape aids in light transmission to the key tops.

In the preferred embodiment, the electroluminescent panel 118 lies above and adjacent the actuator layer 108. The electroluminescent panel 118 is of a type known in the art, and serves as the source of illumination for the keypad 100. Two conductors 122 are used to apply a conventional voltage to the electroluminescent panel 118. In the preferred configuration of the invention, the electroluminescent panel 118 contains at least one aperture 120 sized and spaced to receive a corresponding post 112A of the actuator layer 108. The post 112A protrudes through the aperture 120 with enough clearance to allow for easy movement of the post relative to the electroluminescent panel 118.

A flexible surface layer 124 overlies the electroluminescent panel 118, the actuator layer 108, and the circuitry layer 102. The surface layer preferably consists of an elastomeric material, which provides sufficient flexibility and ease of molding. The surface layer 124 includes at least one portion that comprises a key 128B. The key 128B is approximately aligned with, but preferably not attached to, a corresponding post 112B of the actuator layer and aperture 120 of the electroluminescent panel. When a key 128B on the surface layer is depressed, the key 128B, in turn, urges the corresponding post 112B downward. Depression of the post 112B lowers the conductive element 116B until the conductive element contacts a corresponding switch area 104B of the circuitry layer 102. Contact between the conductive element 116B and the switch area 104B closes a circuit, thereby closing a switch.

The combination of an upwardly extending post 112A and a flexible surface layer 124 allows for a variety of configurations of the surface layer 124. In one such configuration, the keys 128A are raised, the raised area being in one of a number of possible shapes, such as rectangular. The raised keys 128A are shaped so that their sides 129 rise approximately orthogonal to the base web 126 of the surface layer. A bezel 132 overlies the surface layer 124 so that apertures 136 in the bezel receive corresponding raised keys 128A.

In an alternate configuration, the flexible surface layer 124 may be shaped so that the keys 128A are contoured rather than sharply raised. In such a configuration a bezel 132 is not necessary. In another configuration, the keys 128A do not rise above the base web 126 of the surface layer. In such a configuration, markings can be used to delineate the keys 128A. As seen in FIG. 1, the base web 126 itself can be raised above a perimeter base 125 of the surface layer 124.

The lower side 225A of the flexible surface layer 124 may also be shaped in different configurations. In one configuration, the lower side 225A, which contacts the extended post 112A, consists of planar surfaces, and includes a receptacle 226A shaped for receiving the post 112A. In an alternate configuration, the lower side 225B is curved, and also includes a receptacle 226B for receiving the post 112B.

Preferably, the flexible surface layer 124 consists of a translucent elastomeric material. As seen in FIG. 2, the surface layer 124 can have a white translucent layer 204 painted or otherwise coated upon it. Above this is an opaque layer 206. One or more etched markings, or indicia 130, can be made through the opaque layer, thereby allowing light to be emitted through the indicia. The white translucent layer 204 aids in visibility during daylight hours. The light from the electroluminescent panel 118 is carried by a post 112A, the post acting as a light pipe to carry the light upward toward the surface layer 124A. The light passes through the translucent surface layer 124 and the white translucent layer 204, and finally through the indicia 130 etched into the opaque layer 206. Some light is transmitted directly from the electroluminescent panel 118 upward toward and through the surface layer 124 without passing through the post 112A. The light passing through the different pathways provides uniform illumination of the indicia 130 on the surface layer 124. Alternatively, the indicia 130 may consist of opaque markings on a translucent background, resulting in the illumination of the background rather than the indicia.

As illustrated in FIG. 2, when a key 128B is depressed, the corresponding post 112B is urged downward toward the circuitry layer 102. The conductive element 116B attached to the bottom end of the post 112B moves with the post until the conductive element contacts a corresponding switch area 104B on the circuitry layer 102, thereby completing a circuit and closing the switch. When the post 112B is urged downward, the cone 113B coupled to the post 112B collapses, generally in an asymmetric manner. The uneven collapsing of the cone 113B provides tactile feedback, which is transmitted upward through the post 112B and through the key 128B to an operator. When the key 128B is released, the elasticity of the cone 113B coupled to the post 112B, and the elasticity of the flexible surface layer 124, urge the post 112B and key 128B upward and back to their original respective positions as shown by post 112A and key 128A in FIG. 2.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An illuminated flexible-touch keypad providing at least one key, the key being illuminated with a substantially uniform light intensity, the keypad comprising:

(a) a circuitry layer having conductors thereon;

(b) an actuator layer overlying the circuitry layer, the actuator layer having a nonconductive base web and at least one translucent post, the post protruding up from the base web and arranged to be substantially aligned with a corresponding conductor on the circuitry layer;

(c) an electroluminescent panel overlying the actuator layer, the electroluminescent panel containing at least one aperture substantially aligned with and established to receive a corresponding post of the actuator layer, and through which the post protrudes; and (d) a flexible surface layer overlying the electroluminescent panel, at least one portion of the surface layer comprising at least one key, the portion comprising one key being substantially aligned with a corresponding post of the actuator layer.

2. The keypad of claim 1, wherein the flexible surface layer is translucent.

3. The keypad of claim 2, wherein an opaque coating overlies the flexible surface layer, the coating containing at least one etched marking, the marking allowing light to be emitted.

4. The keypad of claim 3, wherein the post of the actuator layer is approximately aligned with a corresponding etched marking on the surface layer.

5. The keypad of claim 1, wherein the flexible surface layer comprises an elastomeric material.

6. The keypad of claim 1, wherein the surface layer comprises a base web, and the portion of the surface layer comprising one key is raised above the base web of the surface layer.

7. The keypad of claim 6, further comprising a bezel overlying the flexible surface layer, the bezel containing at least one aperture arranged and established to receive the raised portion of the flexible surface layer comprising one key and through which the raised portion of the flexible surface layer protrudes.

8. The keypad of claim 1, wherein the circuitry layer comprises a printed conductive membrane circuit.

9. The keypad of claim 1, wherein the base web of the actuator layer consists of a nonconductive elastomeric material.

10. The keypad of claim 9, wherein the post of the actuator layer is made of elastomeric material.

11. The keypad of claim 10, wherein the flexible-touch keypad provides tactile feedback when a key is depressed.

12. The keypad of claim 11, wherein the actuator layer further comprises an elastomeric cone connecting the post to the actuator layer, the cone functioning to provide tactile feedback when the post is depressed and the cone collapses.

13. The keypad of claim 10 wherein the post is generally cylindrically shaped having a first end and a second end, the first end being closer to the surface layer than the second end, and wherein the first end is tapered.

14. The keypad of claim 10 wherein the post and the base web of the actuator layer are an integral unit.

15. The keypad of claim 10 wherein the base web contains at least one aperture established to receive the post, and the post protrudes above the base web from the aperture within the base web.

16. The keypad of claim 10 wherein the post has a first end and a second end, the first end being closer to the surface layer than the second end, wherein the post is nonconductive, wherein the actuator layer further comprises a conductive element attached to the second end of the post, and the conductive element is spaced apart from the circuitry layer and movable in order to contact the corresponding conductor on the circuitry layer.

17. An illuminated flexible-touch keypad providing at least one key, the key being illuminated with a substantially uniform light intensity, the keypad comprising:

(a) a circuitry layer having a plurality of conductors thereon;

(b) a flexible surface layer overlying the circuitry layer, at least one portion of the surface layer comprising at least one key;

(c) an actuator layer positioned between the circuitry layer and the flexible surface layer;

(d) an electroluminescent panel positioned between the circuitry layer and the flexible surface layer; and (e) a translucent member functioning as a light pipe to transmit light toward the surface layer, the translucent member extending from at least adjacent the electroluminescent panel to adjacent the surface layer.

18. The keypad of claim 17, wherein the electroluminescent panel overlies the actuator layer.

19. The keypad of claim 17, wherein the translucent member extends from below the electroluminescent layer to adjacent the surface layer.

20. The keypad of claim 17, wherein the translucent member is attached to the actuator layer.

21. The keypad of claim 20, wherein the electroluminescent panel overlies the actuator layer, the electroluminescent panel contains at least one aperture, and the translucent member protrudes through the electroluminescent panel.

22. The keypad of claim 17, wherein the actuator layer comprises a nonconductive material.

23. The keypad of claim 22, wherein the actuator layer further comprises a conductive element attached to the nonconductive material.

24. The keypad of claim 17, wherein the translucent member is movable between a first position and a second position, the member being arranged to be substantially aligned with a corresponding conductor on the circuitry layer.

25. The keypad of claim 24, wherein the actuator layer further comprises a conductive element attached to an end of the member and movable with the member.

26. The keypad of claim 25, wherein the conductive element does not contact the corresponding conductor on the circuitry layer when the corresponding member of the actuator layer is in the first position, and the conductive element contacts the corresponding conductor on the circuitry layer when the corresponding member of the actuator layer is in the second position.

27. The keypad of claim 17, wherein the flexible surface layer is translucent.

28. The keypad of claim 27, wherein an opaque coating overlies the flexible surface layer, the coating containing at least one etched marking, the marking allowing light to be emitted.

29. The keypad of claim 17, wherein the flexible-touch keypad provides tactile feedback when a key is depressed.

30. The keypad of claim 29, wherein the actuator layer further comprises an elastomeric cone connecting the translucent member to the actuator layer, the cone functioning to provide tactile feedback when the translucent member is depressed and the cone collapses.

* * * * *